US005310637A

United States Patent [19]

Kurz et al.

[11] Patent Number: 5,310,637

[45] Date of Patent: May 10, 1994

[54] MINIMIZATION OF RIPPLE BY CONTROLLING GELATIN CONCENTRATION

[75] Inventors: Mark R. Kurz, Rochester; Steven J. Weinstein, Fairport; Kenneth J. Ruschak, Rochester, all of N.Y.

[73] Assignee: Eastman Kodak Company, Rochester, N.Y.

[21] Appl. No.: 868,827

[22] Filed: Apr. 14, 1992

[51] Int. Cl.[5] ..... G03C 1/46

[52] U.S. Cl. ..... 430/502; 430/935; 430/539; 430/642; 430/496; 430/631; 427/420; 427/414

[58] Field of Search ..... 430/502, 935, 539, 642, 430/496, 631; 427/420, 414

[56] References Cited

U.S. PATENT DOCUMENTS

| | | | |
|---|---|---|---|
| H874 | 1/1991 | Suzuki et al. . | |
| H1003 | 12/1991 | Ishiwata et al. . | |
| 3,508,947 | 4/1970 | Hughes | 430/538 |
| 3,920,862 | 11/1975 | Damschroder et al. | 427/420 |
| 3,928,679 | 12/1975 | Jackson et al. | 430/395 |
| 4,444,926 | 4/1984 | Ogawa et al. | 430/621 |
| 4,569,863 | 2/1986 | Koepke et al. | 427/420 |
| 4,572,849 | 2/1986 | Koepke et al. | 427/420 |
| 4,898,810 | 2/1990 | Eggert et al. | 430/523 |
| 4,916,049 | 4/1990 | Toya | 430/531 |
| 4,923,790 | 5/1990 | Kato et al. | 430/523 |
| 4,983,506 | 1/1991 | Ono et al. | 430/531 |
| 4,983,509 | 1/1991 | Inoue et al. | 430/627 |
| 5,037,729 | 8/1991 | Furlan et al. | 430/539 |

*Primary Examiner*—Charles L. Bowers, Jr.
*Assistant Examiner*—Thomas R. Neville
*Attorney, Agent, or Firm*—Scott M. Terrillion; Carl F. Ruoff

[57] ABSTRACT

A method of reducing the tendency toward formation of ripple imperfections in the coating of multilayer photographic elements is disclosed. Coating compositions are prepared for upper, middle, and lower gelatin-containing layers of a layered mass. The middle layer has a gelatin concentration within three weight percent of each of the upper and lower layers and the upper, middle, and lower layers each have a viscosity that differs from a norm by no more than 15%. A laminar flow of a layered mass including the coating compositions is formed and then received as a layered coating on a moving support. A multilayer photographic element is also disclosed.

14 Claims, 2 Drawing Sheets

MINIMIZATION OF RIPPLE BY CONTROLLING GELATIN CONCENTRATION

FIELD OF THE INVENTION

The present invention relates to an improved method of coating multilayer liquid packs on moving webs. More particularly, the present invention relates to a method for reducing the likelihood of ripple imperfections in the coating of multilayer photographic elements.

BACKGROUND OF THE INVENTION

In many instances it is desired to coat the surface of an object with a plurality of distinct, superposed layers (collectively, the plurality of layers is also known as a coating pack). For example, a common commercial operation involves application of a plurality of paint coatings to an article. Another common example is the manufacture of photographic elements, such as photographic film or paper, wherein a number of layers (up to ten or more) of different photographic coating compositions must be applied to a suitable support in a distinct layered relationship The uniformity of thickness of each layer in the photographic element must be controlled within very small tolerances.

Common methods of applying photographic coating compositions to suitable supports involve simultaneously applying the superposed layers to the support. Typically, a coating pack having a plurality of distinct layers in face-to-face contact is formed and deposited on the object so that all the distinct layers are applied in a single coating operation. In the photographic industry, several such coating operations may be performed to produce a single photographic element. Several methods and apparatus have been developed to coat a plurality of layers in a single coating operation. One such method is by forming a free falling, vertical curtain of coating liquid which is deposited as a layer on a moving support Exemplary "curtain coating" methods of this type are disclosed in U.S. Pat. Nos. 3,508,947 to Hughes, 3,632,374 to Grieller, and 4,830,887 to Reiter "Bead coating" is another method of applying a plurality of layers to a support in a single coating operation. In typical bead coating techniques, a thin liquid bridge (a "bead") of the plurality of layers is formed between, for example, a slide hopper and a moving web. The web picks up the plurality of layers simultaneously, in proper orientation, and with substantially no mixing between the layers Bead coating methods and apparatus are disclosed, for example, in U.S. Pat. Nos. 2,681,294 and 2,289,798.

In both bead coating and curtain coating methods, it is necessary to set and/or dry the layered coating after it has been applied to the support. To accomp'sh this, the web is typically conveyed from the coating application point to a chill section. Subsequently, the web is conveyed through a series of drying chambers after which it is wrapped on a winder roll. Space constraints for the coating machine, cost considerations, and flexibility of design may dictate that one or more inclined web paths be present in conveying the coated substrate from the coating point to the chill section and drying chambers.

Advancements in coating technology have led to increased numbers of layers coated at each coating station, increased total pack thickness per station, thinner individual layers, use of rheology-modifying agents, and the development of new, sophisticated chemistries. In addition, a multilayer photographic coating can consist of sensitizing layers and/or additional, non-imaging, layers. As a result, the chemical composition of the multilayer coating pack is often markedly different from one layer to the next.

In accordance with the present invention, it has been discovered that the above-mentioned factors, in conjunction with the use of web paths implementing vertical components (inclines), has led to the development of a certain, specific nonuniformity in the coated layers. It has been found that this nonuniformity, referred to herein as "ripple" or "ripple imperfection", is caused by interfacial wave growth in the flow of a multilayer coating on the web. Ideally, the flow of the layers on the web is plug (i.e., all layers, as well as the web, are moving at the same speed). However, it has been found in accordance with the present invention that inclined web conveyance ,paths facilitate a gravity-induced flow of the layers relative to the web. This gravity-induced flow supports the existence of waves which increase in amplitude as the layers translate with the web. It is believed that this wave growth is manifested as "ripple".

The causes of and solutions to the problem of ripple imperfections in multilayer coatings have gone largely unexplored. The present invention addresses this problem and discloses a method of reducing the likelihood and severity of ripple formation in coating multilayer liquid packs.

SUMMARY OF THE INVENTION

In accordance with the present invention, it has been discovered that ripple imperfections can occur in multilayer coating packs when there are viscosity differences between adjacent layers after coating those layers on a moving web. These viscosity differences can arise on the web even when delivered viscosities (i.e., viscosities before coating on the web) are equal. Post-coating viscosity shifts can be caused, for example, by interlayer mass transport of solvents between layers or from thermal effects. It has been determined that the propensity of a given multilayer coating pack to exhibit ripple is dependent on many variables. Copending U.S. application Ser. No. 07/868,829, entitled "Method of Coating Multilayer Photographic Elements", filed on Apr. 14, 1992, now allowed discusses many of the variables involved in ripple control and discloses a method of coating with a reduced tendency toward ripple.

Another variable associated with the formation of ripple imperfections is the relative gelatin concentration in adjacent, gelatin-containing layers. It is believed, in accordance with the present invention, that an osmotic pressure difference between adjacent layers drives interlayer water diffusion in gelatin-containing multilayer coating packs, such as commonly used in the photographic industry. In many cases, osmotic pressure differences may result from significant differences in the layer concentrations of gelatin and other addenda. In accordance with the present invention, it has been discovered that the tendency toward the formation of ripple imperfections in multilayer coatings can be reduced by controlling the gelatin concentration of adjacent layers. For example, in a multilayer coating pack having upper, middle, and lower gelatin-containing layers, respectively, the tendency toward the formation of ripple will be greatly reduced if the middle layer has a gelatin concentration within three weight percent of the gelatin concentration of each of the upper and lower layers and each of the layers has a viscosity which differs from a norm by no more than fifteen percent.

In one embodiment of the present invention a method for reducing the tendency toward formation of ripple imperfections in the coating of a multilayer photographic element is disclosed. The method includes the steps of preparing a layered mass having upper, middle, and lower gelatin-containing layers, respectively, wherein the middle layer of the layered mass has a gelatin concentration within three weight percent, preferably one weight percent, of the gelatin concentration of each of the upper and lower layers and each of the layers has a viscosity which differs from a norm by no more than 15 percent, preferably 5%. A laminar flow of the layered mass which includes the compositions as distinct layers, with the middle layer being contiguous to the upper and lower layers is then formed and this layered mass is received as a layered coating on a moving support. The laminar flow is preferably formed on an inclined plane such as a slide hopper as used in the photographic industry. The layered mass is received on the moving support, preferably by curtain coating or bead coating techniques.

In a second embodiment of the present invention, ripple imperfections are detected in a layered mass containing upper, middle, and lower gelatin-containing layers to be received by a moving web. In this embodiment, gelatin concentrations and viscosities of the coating compositions are adjusted such that each of the upper, middle, and lower layers has a viscosity which differs from a norm by no more than 15%, preferably 5%, and that the difference in gelatin concentrations between the middle layer and upper and/or lower layers is reduced to within 3 weight percent and, preferably, within 1 weight percent.

Also disclosed is a multilayer photographic element. The element includes a layered mass coated on a support. The layered mass includes photographic compositions for an upper gelatin-containing layer, a middle gelatin-containing layer adjacent to the upper layer, and a lower gelatin-containing layer adjacent to the middle layer. At least one of the layers contains light sensitive photographic material and the middle layer of the multilayer coating pack has gelatin concentration within three weight percent, preferably one weight percent, of the gelatin concentration of each of the upper and lower layers. Each of the layers has a viscosity which differs from a norm by no more than 15%, preferably 5%.

The present invention enables the design and use of coating compositions that exhibit a greatly reduced tendency toward the formation of ripple imperfections. The present invention helps obviate a significant coating problem that will become increasingly prelevant, especially in the photographic industry, as any or all of the following coating conditions are implemented: increasing numbers of layers coated at each coating station, increased total pack thickness, thinner individual layers, use of rheology-modifiers, or development of new, sophisticated chemistries.

DETAILED DESCRIPTION OF THE INVENTION

Figure 1:
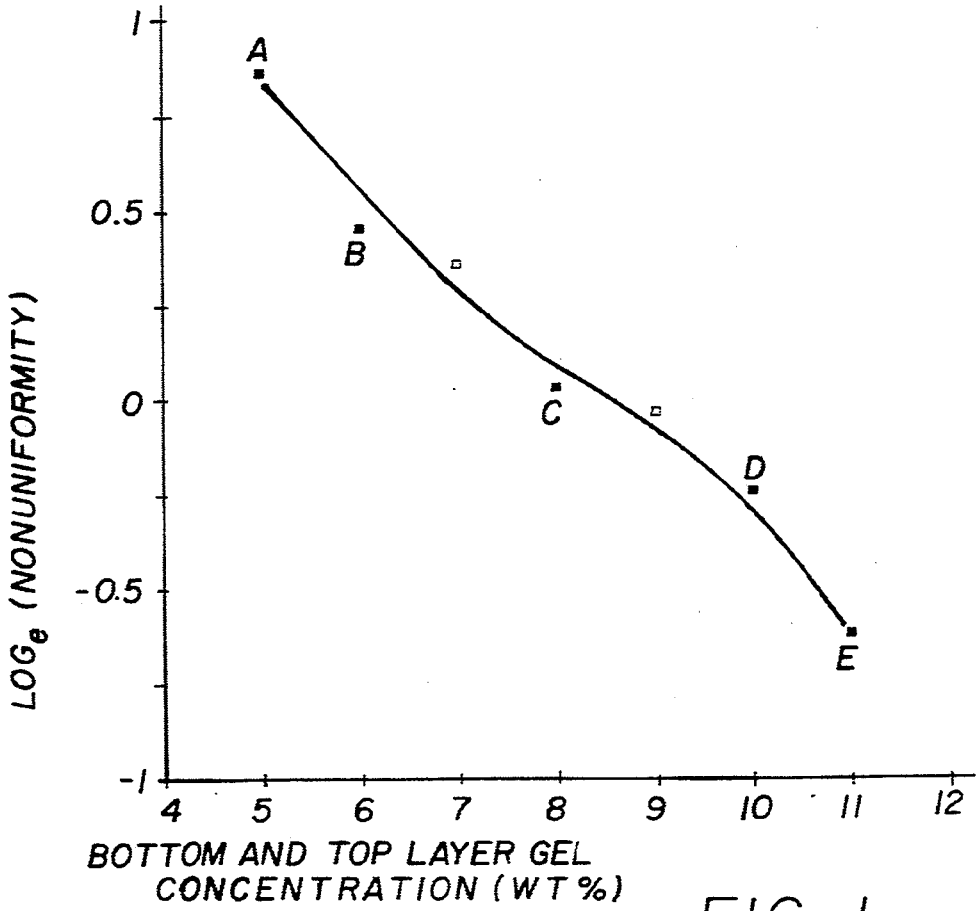
FIGS. 1 and 2 are graphs illustrating the effect of relative gelatin concentrations between layers on ripple severity in multilayer coating packs.

While the invention is specifically described herein with reference to the manufacture of photographic elements, it will be appreciated that it is of much wider application and can be advantageously utilized in numerous fields where it is desirable to effect simultaneous application of three or more distinct superposed layers of liquid.

The present method includes the step of first preparing coating compositions for upper, middle, and lower gelatin-containing layers of a layered mass suitable for coating on a moving web. The middle layer has a gelatin concentration within three weight percent, preferably one weight percent, of the gelatin concentration of each of upper layer and lower layer of the layered mass. The upper, middle, and lower layers each have a viscosity which differs from a norm by no more than 15%, preferably 5%. The norm is determined by calculating the average viscosity of the upper, middle, and lower layers. The viscosities are measured before the layers are coated on the web. Next, a laminar flow of the layered mass which includes the coating compositions as contiguous upper, middle, and lower layers is formed and received as a layered coating on a moving support at a coating application point.

Ripple or ripple imperfection is defined for the Purposes of this invention as a layer thickness nonuniformity resulting from wave growth at the fluid-fluid interfaces of a plurality of layers due to a hydrodynamic instability of the gravity-induced flow of the plurality of layers on a coated web. While not wishing to be bound by theory, it is believed in accordance with the present invention that ripple imperfections arise when there are viscosity differences between adjacent layers of multilayer coating packs. These viscosity differences can be introduced in a variety of ways, including initial viscosity differences between the various layers as delivered to the web or changes in relative layer viscosities from thermal effects after the layers are coated on a web. Another cause may be interlayer mass transport of solvent, for example. One example of this can be seen in the coating of photographic elements, where adjacent layers often contain varying amounts of gelatin. It is thought, in accordance with the present invention, that these differences cause water diffusion between the layers which, in turn, can significantly alter the resulting viscosities of the individual layers after they are coated on the web. In this way, viscosity disparities between layers may be introduced on the web for layers which were originally coated at nominally equal viscosities.

Ripple is manifested by the presence of waves of growing amplitude at the fluid-fluid interfaces between layers of the coated web. In a frame of reference moving with the web, these waves will move along the fluid-fluid interfaces in the direction of the gravity driven flow, while the plurality of layers continues to translate with the web along the conveyance path. Ripple, as described in this invention, is to be contrasted from other potential hydrodynamic instabilities such as those occurring on a hopper slide and the like. The method of the present invention will reduce the likelihood of gravity-driven ripple imperfections in the coating of multilayer photographic elements.

Ripple imperfections occur after the impingement of the layered mass as a layered coating on a moving web (the "coating application point") and before the layered mass is substantially set (the "set point"). In other words, the coating compositions comprising the layered mass on the moving web must be in a liquid form for ripple to occur. Likewise, it has been discovered in accordance with the present method that ripple only occurs on those portions of the web path (between the coating application point and the set point) that have a vertical component. The direction of the vertical component is irrelevant.

It has also been discovered that certain layer configurations and conditions increase the likelihood of ripple imperfections occurring. For example, there must be at least one internal layer (i.e., a layer having two fluid-fluid interfaces) for ripple to occur. In other words, the layered mass coated on the moving web must have at least three distinct layers. Although the present method is equally applicable to the coating of any number of layers greater than three, the invention will be described in detail with reference to a layered mass having three layers. The "lower" layer is the layer which is in contact with the lower interface of the "middle" or "internal" layer. The "middle" or "internal" layer is the layer having two fluid-fluid interfaces. The "upper" layer is the layer which is in contact with the upper interface of the middle or internal layer. In a three-layer coating, the lower layer is also in contact with the web and the upper layer has a gas-fluid interface. For coatings of more than three layers, the lower and upper layers may be internal as well.

Ripple is more likely to occur if the internal layer is deeper within the layered mass (i.e., closer to the middle of the layered mass). For instance, as the middle layer approaches a nominally central location in the layered mass, the ripple severity increases. Ripple is also more likely to occur if the middle layer is relatively thin as compared to the total thickness of the coating.

Ripple is also more likely when the middle layer has a viscosity significantly higher or significantly lower than the viscosity of both the adjacent layers. For example, a three-layer coating with a middle layer having a viscosity less than 0.8 times the viscosity of the adjacent layer with the lower viscosity, or a three-layer coating with a middle layer whose viscosity is greater than 1.5 times the viscosity of the adjacent layer with the higher viscosity is likely to exhibit ripple.

As disclosed in copending U.S. application Ser. No. 07/868,829 entitled "Method of Coating Multilayer Photographic Elements", filed Apr. 14, 1992, now allowed, it has been determined that layered masses having a "ripple value" above a certain value are likely to exhibit ripple imperfections. The ripple value can be determined according to the following formula:

$$X = \frac{(\rho)(g)(d_T)(L_{VT})}{2\mu(V_W)},$$

where X is the ripple value. The higher ripple value X is, the more likely it is that ripple will occur. Ripple can occur when ripple value X is greater than 20. Ripple imperfections are more likely to occur when ripple value X is greater than 35, and very likely still to occur when ripple value X is greater than 75.

$\rho$ is the critical density of the plurality of layers. The critical density is defined as the density of the coating composition having the highest density.

g is a constant representing acceleration due to gravity (i.e., 9.8 m/sec$^2$).

$d_T$ is the total thickness of the layered mass.

$L_{VT}$ is the total vertical distance of the web path from the coating application point to the set point. $L_{VT}$ is an absolute value, i.e., it does not matter if the vertical component is upward or downward. Where the web path includes only one straight section having a vertical component, $L_{VT}$ is equal to $(L)|\sin\beta|$ wherein L is the total length of the web path from the coating application point to the set point and B is the angle of inclination of the web path. A web path can have many different sections, being straight and/or curved, having a vertical component. For a curved web path in which an upward moving web turns downward (or vice versa) the web path must be divided into a series of distinct, curved sections. For each distinct, curved section the vertical component of the web motion can be only upward or only downward. If the web path has multiple, differing vertical components, $L_{VT}$ can be determined according to the formula:

$$L_{VT} = \sum_{i}^{n} |L_{vi}|$$

wherein $L_{vi}=L_i|\sin\beta_i|$ for a straight inclined section and $L_{vi}$=the vertical component of a curved conveyance section. i is an integer of one or more, n is the total number of differing inclined sections of the web path, $L_i$ is the length of each individual section having a vertical component, and $\beta_i$ is the angle of inclination of each straight individual section having a vertical component. $L_{VT}/V_W$ is equal to the effective incline residence time ($t_r$). The effective incline residence time is the total time the layered mass would spend on a vertical path as it travels on the web from the coating application point to the set point.

$\mu$ is the critical viscosity of the plurality of layers. The critical viscosity is defined as the viscosity of the coating composition with the lowest viscosity. Because of the difficulty in measuring or determining the viscosity of the layers after they are coated on the moving web, the critical viscosity can be measured either as delivered to the web (i.e., before the layers are coated on the web) or after coating the layered mass on the web. If possible, it is preferable to determine the critical viscosity after coating the layered mass on the web. For example, in preparing gelatin-containing photographic elements, the measuring can include anticipating the viscosity values of the layers on the web by predicting the extent of wat :r diffusion between adjacent layers.

$V_W$ is the speed of the moving web over the web path from the coating application point to the set point.

Ripple value X is a dimensionless value and, therefore, the above variables should be expressed in consistent units.

To coat the prepared coating compositions, a laminar flow of a layered mass, which includes the compositions as upper, middle, and lower layers, is formed in accordance with the determined conditions. Any suitable method of forming a laminar flow of the photographic compositions is suitable. Preferably, the flow is formed on an inclined plane. A slide hopper of the type conventionally used to make photographic elements is especially useful in the present method. Exemplary methods of forming a laminar flow on a slide hopper are disclosed in U.S. Pat. Nos. 3,632,374 to Greiller and 3,508,947 to Hughes, the disclosures of which are hereby incorporated by reference.

The flowing layered mass is received on the moving web at a coating application point. Various methods of receiving the layered mass on the web can be utilized. Two particularly useful methods of coating the layered mass on the web are bead coating and curtain coating. Bead coating includes the steps of forming a thin liquid bridge (i.e., a "bead") of the layered mass between, for example, a slide hopper and the moving web. An exemplary bead coating process comprises forcing the coating compositions through elongated narrow slots in the form of a ribbon and out onto a downwardly inclined surface. The coating compositions making up the layered mass are simultaneously combined in surface relation just Prior to, or at the time of, entering the bead of coating. The layered mass is picked up on the surface of the moving web in proper orientation with substantially no mixing between the layers. Exemplary bead coating methods and apparatus are disclosed in U.S. Pat. Nos. 2,761,417 to Russell et al., 3,474,758 to Russell et al., 2,761,418 to Russell et al., 3,005,440 to Padday, and 3,920,862 to Damschroder et al., the disclosures of which are hereby incorporated by reference.

Curtain coating includes the step of forming a free falling vertical curtain from the flowing layered mass. The free falling curtain extends transversely across the web path and impinges on the moving web at the coating application point. Exemplary curtain coating methods and apparatus are disclosed in U.S. Pat. Nos. 3,508,947 to Hughes, 3,632,374 to Greiller, and 4,830,887 to Reiter, the disclosures of which are hereby incorporated by reference.

As indicated above, the method and apparatus of this invention are especially useful in the photographic art for manufacture of multilayer photographic elements, i.e., elements comprised of a support coated with a plurality of superposed layers of photographic coating composition. The number of individual layers can range from two to as many as ten or more. In the photographic art, the liquid coating compositions utilized are of relatively low viscosity, i.e., viscosities from as low as about 2 centipoise to as high as about 150 centipoise, or somewhat higher, and most commonly in the range from about 5 to about 100 centipoise. Moreover, the individual layers applied must be exceedingly thin, e.g., a wet thickness which is a maximum of about 0.015 centimeter and generally is far below this value and can be as low as about 0.0001 centimeter. In addition, the layers must be of extremely uniform thickness, with the maximum variation in thickness uniformity being plus or minus five percent and in some instances as little as plus or minus one percent. In spite of these exacting requirements, the method of this invention is of great utility in the photographic art since it permits the layers to be coated simultaneously while maintaining the necessary distinct layer relationship and fully meeting the requirements of extreme thinness and extreme uniformity in layer thickness.

The method of this invention is suitable for use with any liquid photographic coating composition and can be employed with any photographic support and it is, accordingly, intended to include all such coating compositions and supports as are utilized in the photographic art within the scope of these terms, as employed herein and in the appended claims.

The term "photographic" normally refers to a radiation sensitive material, but not all of the layers presently applied to a support in the manufacture of photographic elements are, in themselves, radiation sensitive. For example, subbing layers, pelloid protective layers, filter layers, antihalation layers, and the like are often applied separately and/or in combination and these particular layers are not radiation sensitive. The invention includes within its scope all radiation sensitive materials, including electrophotographic materials and materials sensitive to invisible radiation as well as those sensitive to visible radiation. While, as mentioned hereinbefore, the layers are generally coated from aqueous media, the invention is not so limited since other liquid vehicles are known in the manufacture of photographic elements and the invention is also applicable to and useful in coating from such liquid vehicles.

More specifically, the photographic layers coated according to the method of this invention can contain light-sensitive materials such as silver halides, zinc oxide, titanium dioxide, diazonium salts, light-sensitive dyes, etc., as well as other ingredients known to the art for use in photographic layers, for example, matting agents such as silica or polymeric particles, developing agents, mordants, and materials such as are disclosed in U.S. Pat. No. 3,297,446. The photographic layers can also contain various hydrophillic colloids. Illustrative of these colloids are proteins (e.g., protein or cellulose derivatives), polysaccharides (e.g., starch), sugars (e.g. dextran), plant gums, synthetic polymers (e.g., polyvinyl alcohol, polyacrylamide, and polyvinylpyrrolidone), and other suitable hydrophillic colloids such as are disclosed in U.S. Pat. No. 3,297,446. Mixtures of the aforesaid colloids may be used, if desired.

It may also be necessary to add deviscosifying agents and/or thickeners in the present method to bring the viscosities of the compositions within 15% of a norm while maintaining the requisite gelatin percentages in adjacent layers. Deviscosifying agents act to reduce the viscosity of a liquid. Thickeners act to increase the viscosity of a liquid. Rheology modifiers can also be used to effect the viscosity profile.

In the practice of this invention, various types of photographic supports may be used to prepare the photographic elements. Suitable supports include film base (e.g. cellulose nitrate film, cellulose acetate film, polyvinyl acetal film, polycarbonate film, polystyrene film, polyethyene terephthalate film and other polyester films), paper, glass, cloth, and the like. Paper supports coated with alpha-olefin polymers, as exemplified by polyethylene and polypropylene, or with other polymers, such as cellulose organic acid esters and linear polyesters, can also be used if desired. Supports that have been coated with various layers and dried are also suitable. The support can be in the form of a continuous web or in the form of discrete sheets. However, in commercial practice, a continuous web is generally used.

Although the present method is useful in preparing coating compositions that exhibit a reduced tendency toward ripple, in another embodiment of the invention, existing compositions can be adjusted to reduce the tendency toward ripple formation. Gelatin-containing coating compositions are first prepared for upper, middle, and lower layers of a layered mass to be received by a moving web. Ripple imperfections are then detected in the layered mass. Ripple imperfections can be detected, for example, in the actual coating process or in a pilot run where the compositions are flowed as a layered mass on an incline and observed for ripple imperfections. Once ripple imperfections have been detected, gelatin concentrations and viscosities of the coating compositions are adjusted such that each of the three layers has a viscosity which differs from a norm by no more than 15%, preferably 5%, and that the difference in gelatin concentrations between the middle layer and upper and/or lower layers is reduced to within 3 weight percent and, preferably, within 1 weight percent.

A multilayer photographic element is also disclosed in accordance with the present invention. The element includes a support and a gelatin-containing layered mass coated on the support. The layered mass includes photographic compositions as upper, lower and middle gelatin-containing layers with the middle layer having a gelatin concentration within three weight percent, preferably one weight percent, of the upper and lower layers and each of the layers having a viscosity that differs from a norm by no more than 15%, preferably 5%. At least one of the layers in the photographic element of the present invention contains light-sensitive materials such as silver halides, zinc oxide, titanium dioxide, diazonium salts, or light-sensitive dyes.

The invention is further illustrated by the following examples.

EXAMPLES

Coating compositions for a three-layer coating pack were prepared. The compositions contained water, surfactant, thickener, and gelatin. The prepared coating packs were curtain coated onto a continuous polyethylene terephthalate web using a three-slot slide hopper. The web path was nominally vertical.

Layer viscosities were obtained by using variable amounts of gelatin and a thickening agent. The weight percentage of gelatin in a given layer ("gel %") was used to quantify the gelatin concentration in the layer. In each sample, the viscosity of each composition as delivered to the web was nominally equal at 35 cP. Upon coating, the differing gelatin concentrations of the compositions resulted in water diffusion from layers of low gelatin concentration to layers of high gelatin concentration. This water diffusion between the thin coated layers led to a new viscosity profile in the coated plurality of layers. The viscosifying agent used to adjust the viscosity of various layers was a potassium salt of octadecyl hydroquinone sulfonate.

5-12 ml of TRITON X-200 (a sodium salt of octylphenoxydiethoxyethane sulfonate sold by Union Carbide), was added per pound of gelatin solution as a surfactant. Surfactant was added to the top and bottom layers. To obtain optical density to facilitate visual observation of the ripple imperfection, a carbon dispersion was added to the middle layer of each sample. Dried coating samples were obtained for both visual and numerical quantification. The layers were isothermally coated on the web at 105° F. Viscosities of the delivered layers were measured at a temperature of 105° F.

Black toner particles of approximately 13 micron diameter were introduced into the middle layer of the three-layer system in an effort to introduce hydrodynamic disturbances of known size into the system. Such disturbances induced localized wave formation in the vicinity of the particles and aided in the identification of ripple susceptibility.

Digital images of the coated samples were made using a charge-coupled device ("CCD") camera and were analyzed for the presence of ripple imperfections. FIGS. 1A-1E are 5x magnifications of a 1.0 cm sample of the coated web. FIGS. 2A-2E are 12.5x magnifications of a 0.4 cm sample of the coated web. Wave-form analyses were performed on the digitized images. A lengthwise spatial Fast Fourier Transform (FFT) was performed to provide a measure of the percentage of optical density variation ("%OD") in the carbon-bearing layer over a range of wavelengths. The measured variations in optical density were directly proportional to variations in thickness of the layer bearing the carbon dispersion, and were proportional to the spectral distribution of wave amplitudes in the coating samples. For the purposes of quantifying ripple severity, it was convenient to quantify each experimental %OD variation vs. wavelength spectrum by one number. To do so, the average %OD variation was calculated over a wavelength range containing the wavelength having the largest wave amplitude. This average is a measure of the ripple severity and is termed "Nonuniformity".

EXAMPLE 1

Three coating compositions were prepared according to the procedure outlined above. In each sample, the gelatin concentration of the middle layer was 10.5 weight percent. The gelatin concentrations of the upper and lower layers were the same in each sample but increased with the lowest gelatin concentration in Sample 1 and the highest gelatin concentration in Sample 8. The viscosity of each layer of each sample was 35 centipoise. The three layers were simultaneously curtain coated on the web at a coating speed of 225 feet per minute. The inclined residence time was 2.9 seconds. The thickness of each of the upper and lower layers was 0.0071 cm. The thickness of the middle layer was 0.00071 cm.

The experimental coating conditions and results are outlined in Table I below where NU is nonuniformity. The results are illustrated by FIGS. 1A through 1E. The sample corresponding to each figure is indicated in the "SAMPLE" column.

TABLE I

| SAMPLE | UPPER LAYER GEL % | MIDDLE LAYER GEL % | LOWER LAYER GEL % | NU | $Log_e$ (NU) |
|---|---|---|---|---|---|
| 1(1A) | 5.0 | 10.5 | 5.0 | 2.382 | 0.868 |
| 2(1B) | 6.0 | 10.5 | 6.0 | 1.587 | 0.462 |
| 3 | 7.0 | 10.5 | 7.0 | 1.439 | 0.364 |
| 4(1C) | 8.0 | 10.5 | 8.0 | 1.032 | 0.0315 |
| 5 | 9.0 | 10.5 | 9.0 | 0.971 | −0.0294 |
| 6(1D) | 10.0 | 10.5 | 10.0 | 0.764 | −0.269 |
| 7(IE) | 11.0 | 10.5 | 11.0 | 0.540 | −0.616 |
| 8 | 12.0 | 10.5 | 12.0 | 0.968 | −0.0325 |

Figure 1A:
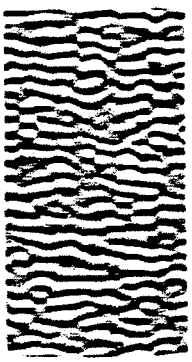
FIGS. 1A-1E and 2A-2E are series of photomicrographs illustrating the effect of the relative gelatin concentrations between layers on ripple severity in multilayer coating packs.
Figure 1B:
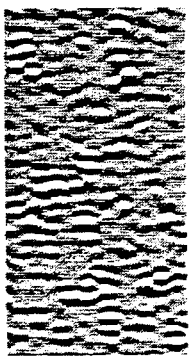

FIG. 1 indicates that as the gel percent of the lower and upper layers approaches the gel concentration of the middle layer, ripple severity steadily decreases. FIGS. 1A-1E indicate that no significant ripple formation occurs until Sample 4 (FIG. 1C), as the gel % difference between the middle layer and the upper and lower layers approaches 3 wt. %. Ripple severity steadily increases as the gel % differences grow larger as shown by FIGS. 1, 1A, and 1B.

EXAMPLE 2

Coating compositions were prepared according to Example 1 except that the initial gel concentration of the middle layer was 5.0 weight percent in each sample. The experimental coating conditions are outlined in Table II below where NU is nonuniformity. The results are illustrated by FIGS. 2A-2E. The sample corresponding to each figure is indicated in the "SAMPLE" column.

TABLE II

| SAMPLE | UPPER LAYER GEL % | MIDDLE LAYER GEL % | LOWER LAYER GEL % | NU | $Log_e$ (NU) |
|---|---|---|---|---|---|
| 9(2A) | 5.0 | 5.0 | 5.0 | 0.706 | −0.38 |
| 10 | 6.0 | 5.0 | 6.0 | 0.807 | −0.214 |
| 11(2B) | 7.0 | 5.0 | 7.0 | 1.160 | 0.418 |
| 12(2C) | 8.0 | 5.0 | 8.0 | 2.188 | 0.783 |
| 13(2D) | 9.0 | 5.0 | 9.0 | 5.486 | 1.702 |
| 14(2E) | 10.0 | 5.0 | 10.0 | 7.753 | 2.048 |

Figure 1C:
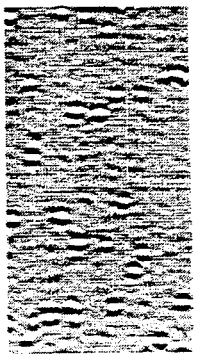
Figure 1D:
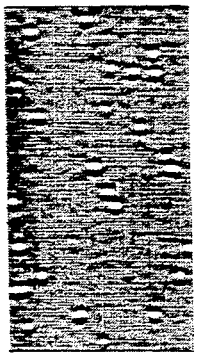
Figure 1E:
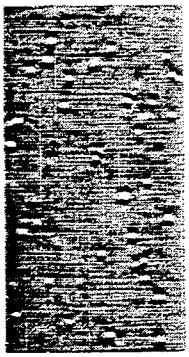
Figure 2:
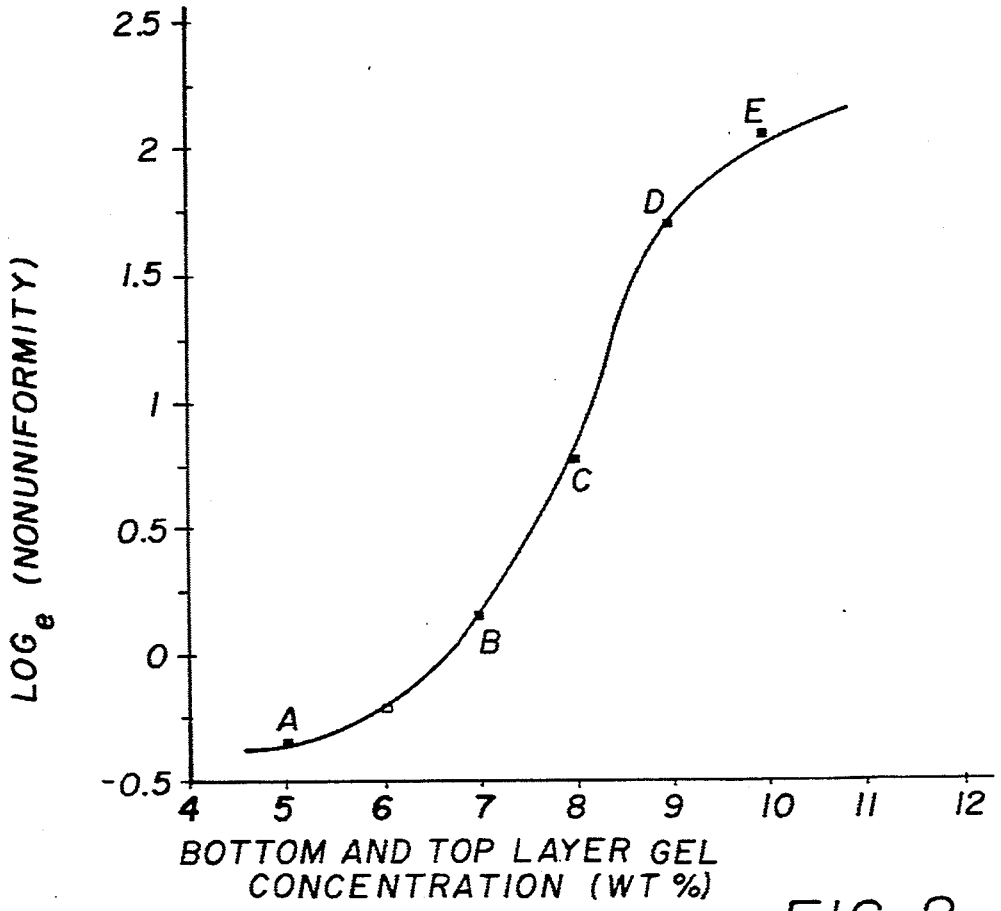
Figure 2A:
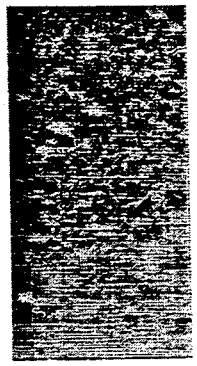
Figure 2B:
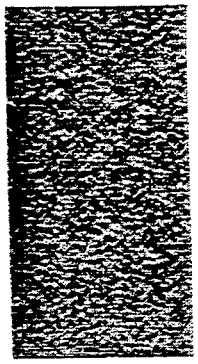
Figure 2C:
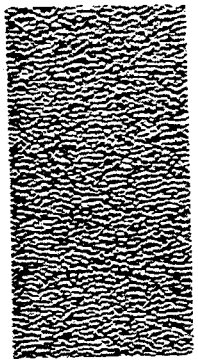
Figure 2D:
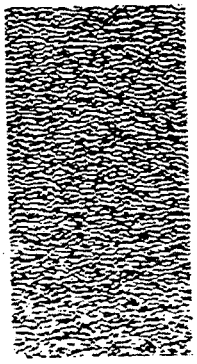
Figure 2E:
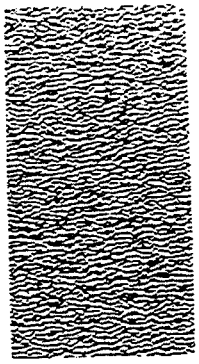

FIG. 2 indicates that as the gel concentration of the upper and lower layers becomes increasingly disparate relative to the gelatin concentration of the middle layer, ripple severity steadily increases. FIGS. 2A-2E indicate that no significant ripple formation occurs until Sample 12 (FIG. 2C), as the gel % difference approaches 3 wt. %. Ripple severity steadily increases as the gel % differences grow larger as shown by FIGS. 2, 2D, and 2E. Samples 9 (gelatin concentration difference of 0 wt. %) and 11 (gelatin concentration difference of 2 wt. %) exhibit virtually no ripple formation, as illustrated by FIGS. 2A and 2B, respectively. In addition, a comparison of the wavelengths of the waves as illustrated by FIGS. 2C-2E with the waves illustrated in FIGS. 1C-1E shows that the viscosity profile of the plurality of layers after coating can be determined by observing the wavelength of the waves formed. In FIGS. 1C-1E (the gel percent configuration yields low viscosity middle layers in each case after diffusion) the wavelength maximums were from about 0.03-0.05 cm, while the waves in FIGS. 2C-2E (the gel percent configuration yields high viscosity middle layers in each case after diffusion) were from about 0.006-0.008 cm. Therefore, Examples 1 and 2 also indicate that ripple waves observed in coating packs with a low viscosity middle layer generally have a longer wavelength than ripple waves observed in a coating pack with a high viscosity middle layer.

The invention has been described in detail with particular reference to certain preferred embodiments thereof, but it will be understood that variations of modifications can be effected within the spirit and scope of the invention as described hereinabove and as defined in the appended claims.

What is claimed is:

1. A method for reducing the tendency toward formation of ripple imperfections in the coating of a multilayer photographic element comprising the steps of:

preparing coating compositions for upper, middle, and lower gelatin-containing layers of a layered mass suitable for coating on a moving web which follows a path from a coating application point to a set point and where said web path has a vertical component not equal to zero, wherein said layered mass has a ripple value X of greater than 20 as determined by the formula:

$$X = \frac{(\rho)(g)(d_T)(L_{VT})}{2\mu(V_w)}$$

where $\rho$ is the critical density g is a constant representing the acceleration due to gravity, $d_T$ is the total thickness of said layered mass, $L_{VT}$ is the total vertical distance of said web path, $\mu$ is the critical viscosity, and $V_w$ is the speed of said moving web, and said middle layer has a gelatin concentration within three weight percent of the gelatin concentration of said upper layer and said lower layer and each of said upper, middle and lower layers has a viscosity which differs from a norm by no more than 15 percent;

forming a laminar flow of the layered mass which includes said compositions as distinct layers, said middle layer being contiguous to said upper and lower gelatin-containing layers; and receiving said layered mass as a layered coating on a moving support at a coating application point.

2. A method according to claim 1, wherein said middle layer has a viscosity on said web less than about 0.8 times the viscosity of both said upper and lower layers.

3. A method according to claim 1, wherein said middle layer has a viscosity on said web greater than about 1.5 times the viscosity of both said upper and lower layers.

4. A method according to claim 1, wherein the viscosities of said upper, middle, and lower layers are the same.

5. A method according to claim 1, wherein said middle layer is nominally centrally located in the layered mass.

6. A method according to claim 1, wherein said ripple value is greater than 35.

7. A method according to claim 1, wherein said ripple value is greater than 75.

8. A method according to claim 1, wherein the gelatin concentration of said middle layer is within 1 weight percent of the gelatin concentration of each of said upper layer and said lower layer.

9. A method according to claim 1, wherein said preparing includes the step of adding deviscosifying agents to one or more of said layers.

10. A method according to claim 1, wherein said preparing includes the step of adding thickeners to one or more of said layers.

11. A method according to claim 1, wherein one or more of said layers contains silver halide photographic material.

12. A method according to claim 11, wherein said forming is on an inclined plane and said receiving is by bead coating.

13. A method according to claim 11, wherein said forming is on an inclined plane and said receiving is by curtain coating.

14. A method according to claim 11, wherein the gelatin concentration of said middle layer is within 1 weight percent of the gelatin concentration of each of said upper and said lower layer.

* * * * *